US007098465B1

(12) United States Patent
Holmes

(10) Patent No.: US 7,098,465 B1
(45) Date of Patent: Aug. 29, 2006

(54) INTEGRATED INERT GAS FOR ELECTROMAGNETIC ENERGY SPOT CURING SYSTEM

(75) Inventor: Mark Holmes, Waterford, CT (US)

(73) Assignee: Henkel Corporation, Rocky Hill, CT (US)

( * ) Notice: Subject to any disclaimer, the term of this patent is extended or adjusted under 35 U.S.C. 154(b) by 75 days.

(21) Appl. No.: 10/875,197

(22) Filed: Jun. 25, 2004

(51) Int. Cl.
*F26B 3/00* (2006.01)

(52) U.S. Cl. ..... 250/492.1; 428/64.1; 428/64.4; 34/267; 34/210

(58) Field of Classification Search ..... None
See application file for complete search history.

(56) References Cited

U.S. PATENT DOCUMENTS 5,521,392 A * 5/1996 Kennedy et al. ..... 250/492.1
6,108,933 A * 8/2000 Vromans et al. ..... 34/267
6,395,124 B1 * 5/2002 Oxman et al. ..... 156/275.5

* cited by examiner

*Primary Examiner*—John R. Lee
*Assistant Examiner*—Zia R. Hashmi
(74) *Attorney, Agent, or Firm*—Steven C. Bauman

(57) ABSTRACT

The present invention provides an electromagnetic energy spot curing method and system which integrates the UV radiation with an inert gas to disperse the gas and the radiation energy simultaneously to cure an adhesive surface on a target or work piece. The system provides a means to cure the adhesive surface during photoinitiation to expel the atmospheric oxygen which otherwise would interfere with the curing cycle.

15 Claims, 2 Drawing Sheets

INTEGRATED INERT GAS FOR ELECTROMAGNETIC ENERGY SPOT CURING SYSTEM

FIELD OF THE INVENTION

The present invention relates generally to an electromagnetic energy spot curing system, and more particularly to an integration of inert gas to an UV curing source unit to overcome oxygen inhibition.

BACKGROUND OF THE INVENTION

Ultraviolet (UV) lamps are well-known in the art to cure certain curable compounds such as adhesives and the like. UV spot curing systems are used in various applications including the curing of industrial sealants for potting electronics, bonding plastics in the medical industry and the curing of dental filling materials, disk drive industry amongst other applications. Generally, the presence of air would reduce curing of the adhesive. During photopolymerization, as you radiate UV energy or light, the free radicals that are formed during curing are destroyed by reaction with oxygen from the air. Therefore, it is desired to integrate an inert gas with an UV irradiance onto the adhesive surface during the curing cycle. This integration of the inert gas overcomes oxygen inhibition associated with photopolymerization of acrylate/methacrylate products.

UV curing devices for curing adhesive between two layers of an information carrier, used particularly for disk drive industry, are disclosed in U.S. Pat. Nos. 6,361,846; 6,170,172; 6,148,542 and 6,108,933. The devices described in these patents is a device that cures the adhesive by means of UV radiation in an inert-gas atmosphere. These devices include a curing chamber or enclosure filled with inert gas that isolates the adhesive from the atmospheric oxygen. However, such devices do not have the ability to accurately focus the light to a confined area or location. Also, the reactive material is required to be enclosed in a chamber. Finally, the curing is performed at a low irradiation intensity making the curing process slow and inefficient.

Therefore, a need exists to provide a spot curing system which overcomes the deficiencies of the prior art.

SUMMARY OF THE INVENTION

The present invention provides an electromagnetic energy spot curing method and system which produces an extremely high UV irradiance resulting in a faster and more efficient process. The system is capable of accurately focusing the light to a specific area needed to be cured. Moreover, the material to be cured need not be enclosed in a chamber. Furthermore, the spot curing system of the present invention is portable and can be integrated into a continuous throughput production system.

The system includes a curing unit having a radiation source positioned to irradiate a work piece with radiation energy. A light guide is positioned opposite the curing unit having a light entrance end for receiving the radiation energy and a light exit end for dispersing the radiation energy on the work piece. The system also includes a tube positioned generally parallel to the light guide having a first end for receiving an inert gas and a second end for dispersing the inert gas on the work piece. Moreover, the system includes a fixture where the light exit end of the light guide is integrated with the second end of the inert gas to disperse the gas and the radiation energy simultaneously onto the work piece thereby curing an adhesive surface on the work piece.

DETAILED DESCRIPTION OF THE INVENTION

The subject invention relates to an electromagnetic energy spot curing system which utilizes a source of radiation found in the electromagnetic spectrum (e.g., ultraviolet (UV); infrared). To describe the invention and illustrate its functioning, reference is made herein to the use of a UV lamp. It is to be understood that the UV lamp can be interchanged with other sources of electromagnetic energy. In addition, the electromagnetic energy source may provide electromagnetic energy of varying intensities and/or of varying wavelengths (e.g., various types of radiation).

Figure 1:
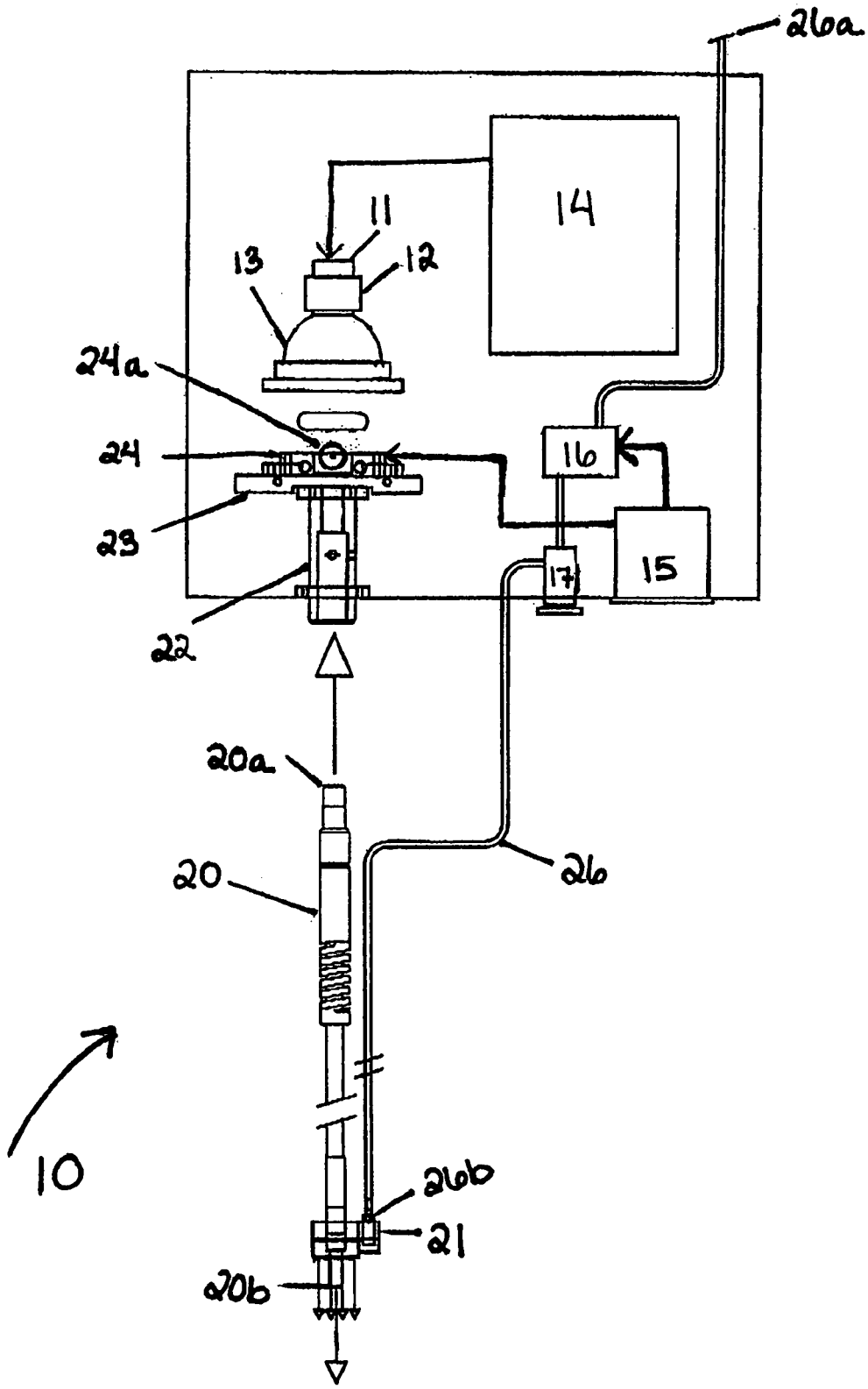
FIG. 1 is a top view of UV spot cure system in accordance with the subject of the invention.
Figure 2:
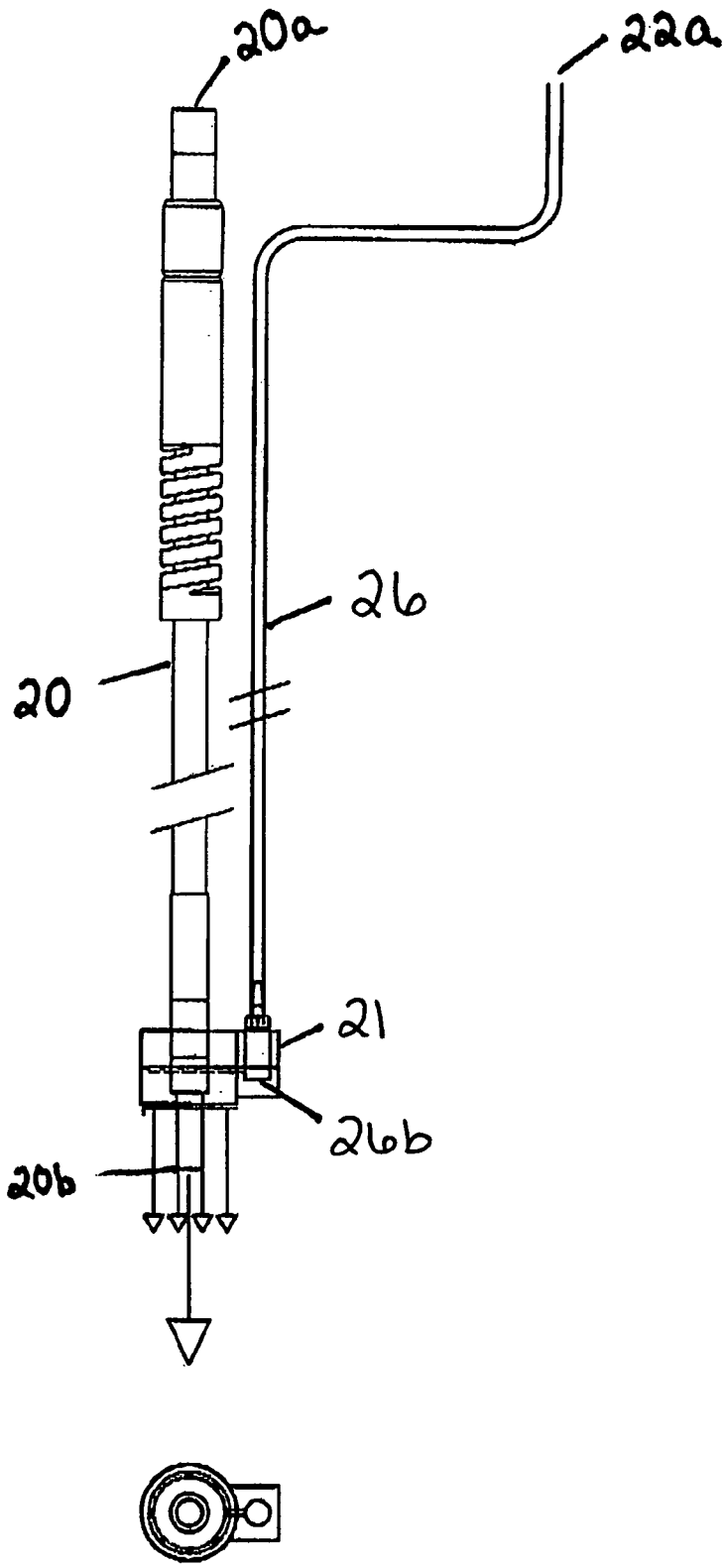
FIG. 2 is a top and front view of the light guide with inert gas attachment of the system.

With reference to FIGS. 1 and 2, an electromagnetic energy spot curing system is generally shown and designated therein with the reference numeral 10.

The system 10 includes a UV lamp 11, including a light source 12 and an elliptic reflector 13. The light source 12 is preferably connected to the elliptic reflector 13 so that the energy emanated from the UV lamp 11 is focused at a precise desired location which is an entrance to a light guide 20.

The UV lamp 11 may preferably be a conventional straight mercury arc lamp, metal halide mercury lamp, a xenon-metal halide lamp or any other suitable radiation emitting lamp known in the art. The lamp 11 is controlled by a ballast 14. Ballast 14 is a known electrical device or chip used in fluorescent and HID fixtures for strating and regulating fluorescent and high intensity discharge lamps. Ballast 14 acts as a power regulating source providing sufficient increasing power for the lamp 11 and further controlling the level of power supplied to the lamp 11.

The light 20 is preferably positioned within a curing unit. The light guide 20 may be glass, optical fiber or any other suitable light transmissive material known in the art, and is preferably of the liquid-filled type. The light guide 20 includes a light entrance surface 20*a* at one end which projects towards the lamp 11 and a light exit/output surface 20*b* at the other end which may be directed to a work site or target which contains adhesive material to be light cured. The light exit surface 20*b* of the light guide 20 terminates at a single fixture 21 from which the UV radiance is dispersed.

The light guide 20 is supported by a light guide tube receptacle 22. The light guide tube 22 is suitably mounted on a light guiding mounting plate 23. Light guide tube 22 has an opening for supportable receipt of the light guide 20 therein. As will be described in more detail below, the light guide 20 acts to at least partially collimate the UV beam E, and the beam is emitted from the light guide 20 via the light exit surface 20*b*. As is readily apparent, the light exit surface 20*b* is directed to the work site or target which contains adhesive material to be light cured.

Furthermore, a shutter/stop mechanism including a shutter 24 which is generally planar and made of aluminum is affixed to the light guide mounting plate 23. The shutter 24 is positioned generally parallel to the lamp 11 to selectively control UV energy emanating from the system. The shutter 24 also has an opening 24*a* of generally circular configuration located at the center of the shutter. Preferably the shutter 24 is located to selectively control UV energy entering the light guide 20 through the light entrance surface 20*a*. The opening and closing of the shutter 24 is described herein. The shutter 24 is movable from a first position, the closed position, wherein a solid portion of the shutter 24 covers the light entrance surface 20*a* of the light guide 20 to a second position, the opened position, wherein the shutter opening 24*a* is in registry with the light entrance surface 20*a* thereby allowing light to pass through the opening 24*a* to the light entrance surface 20*a* of the light guide 20. As the UV light beam passes within the light guide 20, it is emitted from the light guide 20 via the light exit surface 20*b* to the worksite containing adhesive material to be cured.

The mechanism for the movement of the shutter 24 is controlled by a solenoid (not shown). Upon appropriate signals the solenoid is activated which in turn moves the shutter 24 from the first position to the second position as discussed above. A timer 15 preferably controls the time period for shutter 24 to remain in the closed and open positions thereby controlling the exposure time of the radiation. The opening and closing of the shutter 24 may be synchronized with a shut off valve 16 in order to preferably synchronize the UV irradiance with a flow of inert gas as will be described in detail below.

The system additionally includes a tube 26 used to feed and disperse inert gas. Preference is given to argon, but gas such as nitrogen, helium or neon are also suitable. The tube 26 includes one end 26*a* attached to a source from which the inert gas is fed in the tube 26 and an opposing end including a dispersion nozzle 26*b* from which the inert gas is dispersed. The dispersion nozzle 26*b* of the tube 26 is integrated with the light exit surface 20*b* of the light guide 20 into the single fixture 21 and is designed to disperse the inert gas simultaneously with the light output and/or the UV radiance to the adhesive surface of the work piece.

The regulator 17 preferably controls the rate of flow of the inert gas received in the tube 26 via shut off valve 16 thereby controlling the amount of gas to be dispensed onto the work piece. The shut off valve 16 is preferably solenoid operated to start and stop the flow or movement of the inert gas. In other words, when solenoid is activated, which in turn either opens the valve 16 to start the flow of inert gas in the tube 26 received from the source or shuts off the valve 16 to stop the flow of inert gas in the tube 26. Also, the operation of the valve 16 is controlled by the timer 15. The timer 15 is preferably connected to the valve controlling the time period for valve 16 to remain in open and closed positions, thereby controlling the time period of the flow of the inert gas.

In operation, the lamp 11 is activated by the ballast 14 to emanate a focused UV energy beam E through the reflector 13. This focused UV energy beam falls right on the shutter 24. The shutter 24 being movable in a second position as discussed above, wherein the shutter opening 24*a* is aligned with the light entrance surface 20*a*, which allows the UV energy beam to travel into the light guide tube 22 to pass through the light entrance surface 20*a* into the light guide 20. As the UV energy beam is originating from the lamp 11 and passed through the light guide 20, simultaneously, the inert gas provided by a source is fed into the tube 26 which is encountered by the shut-off valve 16. The shut-off valve 16 as discussed above is opened to pass the flow of the inert gas into the tube 26. The shut-off valve 16 causes to initiate the flow or movement of the inert gas through the tube 26 upon the UV energy being emitted. In other words, the relative movement of the inert gas is initiated upon opening of the shutter 24. Both the tube 26 and the light guide 20 terminate at a common fixture 21. In other words, the light exit end 20*b* of the light guide and the dispersion nozzle 26*b* of the tube 26 integrate into the fixture 21 dispensing both the UV energy and the inert gas 21 from the fixture. Therefore, during the curing cycle, both the focused UV energy E and the inert gas are dispersed simultaneously on to the adhesive surface of the worksite. As a result of this operation, material can be cured with the exposure of radiation energy and the dispersion of inert gas simultaneously in order to expel oxygen which would interfere with the curing process. The irradiance levels for spot systems described in the present invention can easily exceed 20 $W/cm^2$, whereas, other systems typically produce no more than a couple of $W/cm^2$, (i.e., Fusion system electrodeless lamp system).

The devices and the system of the present invention can be used in conjunction with a variety of different photocurable adhesive compositions. For example, UV curable vinyl and (meth)acrylate-containing compositions, which may also be optionally anaerobically curable, may be employed. Such compositions may include urethane-acrylate copolymers and block copolymers such as those disclosed in U.S. Pat. Nos. 3,425,988; 4,295,909; and 4,309,526. Other useful photocurable compositions containing reactive (meth)acrylate components are disclosed in U.S. Pat. Nos. 4,415,604; 4,424,252; and 4,451,523, all to Loctite Corporation.

Photoinitiators which are intended to be active primarily in the ultraviolet (UV) region are incorporated along with the curable component, and which upon exposure to sufficient ultraviolet light initiate photopolymerization of the curable component. Such UV compositions can be used as structural adhesives, potting compounds, gap filling compounds, sealing compounds, conformal coatings as well as other applications known to those skilled in the art.

In addition to the aforementioned adhesive compositions, UV curable silicone compositions are also contemplated as being useful with the present invention. Such compositions contain a curable silicone component and a UV photoinitiator component. Additionally, cyanoacrylate adhesives designed to cure upon exposure to photoirradiation may also be employed.

Examples of commercially available UV curing compositions include Loctite product numbers Adhesive 352, 3321, 3491, 3525 and 3201.

Having described the preferred embodiments herein, it should be further appreciated that various modifications may be made thereto without departing from the contemplated scope of the invention. As such, the preferred embodiments described herein are intended in an illustrative rather than a limiting sense. The true scope of the invention is set forth in the claims appended hereto.

What is claimed is:

1. An electromagnetic energy spot curing system comprising:

a curing unit having a radiation source positioned to irradiate a work piece with radiation energy;

a light guide positioned within the curing unit having a light entrance end for receiving the radiation energy and a light exit end for dispersing the radiation energy on the work piece;

a tube positioned generally parallel to the light guide having a first end for receiving an inert gas and a second end for dispersing the inert gas on the work piece; and a fixture wherein said light exit end of the light guide is integrated with the second end of the inert gas to disperse said gas and the radiation energy simultaneously onto an adhesive surface of the work piece.

2. The system of claim 1 further comprising a ballast to provide power to the source.

3. The system of claim 1 wherein said radiation source includes a UV lamp.

4. The system of claim 3 wherein said curing unit further comprises a shutter positioned parallel to the lamp wherein said shutter is selectively movable to allow exposure of radiation energy from said source.

5. The system of claim 4 further comprising a valve for initiating flow of the inert gas into said tube.

6. The system of claim 5 further comprising a timer for controlling operation of the shutter and the valve wherein the flow of the inert gas is initiated upon opening of the shutter.

7. The system of claim 1 further comprising a regulator for controlling rate of flow of the inert gas in said tube.

8. The system of claim 1 wherein said inert gas is argon.

9. The system of claim 1 wherein said inert gas is nitrogen.

10. The system of claim 1 wherein said dispersion of the radiation energy simultaneously with the inert gas expels oxygen interfering with the curing of the adhesive surface on said workpiece.

11. A method of electromagnetic radiation spot curing comprising:

providing a work piece to be cured wherein said workpiece includes an adhesive surface;

integrating an inert gas with an electromagnetic radiation energy in a fixture;

dispersing said gas and the radiation energy simultaneously through said fixture; and exposing the work piece to the radiation and gas simultaneously to spot cure said work piece.

12. The method of claim 1 wherein said exposing step includes:

providing an electromagnetic radiation source; and activating said electromagnetic radiation source to expel oxygen interfering with the curing of the adhesive surface on said work piece.

13. The method of claim 11 wherein said integrating step includes initiating flow of the inert gas upon emission of the radiation energy.

14. The method of claim 11 further comprising:

controlling the exposure of the radiation energy and the dispersion of the gas on said work piece.

15. The method of claim 11 wherein said radiation source is a UV lamp.

* * * * *